United States Patent [19]

Schmidt et al.

[11] Patent Number: 4,589,457

[45] Date of Patent: May 20, 1986

[54] LOG SPLITTER WEDGE CONSTRUCTION

[76] Inventors: Phillip M. Schmidt, 117 Centennial St.; Kenneth P. Schmidt, 3462 Austin Rd., both of Geneva, Ohio 44041

[21] Appl. No.: 688,803

[22] Filed: Jan. 4, 1985

[51] Int. Cl.[4] ..... B27L 7/00

[52] U.S. Cl. ..... 144/193 E; 144/193 R; 144/366

[58] Field of Search ..... 144/193 R, 193 A, 366; 254/104

[56] References Cited

U.S. PATENT DOCUMENTS

| | | | |
|---|---|---|---|
| 899,328 | 9/1903 | Saecker . | |
| 3,077,214 | 2/1963 | Brukner | 144/193 A |
| 4,103,724 | 8/1978 | Braid | 144/193 E |
| 4,240,476 | 12/1980 | Rattray | 144/193 |
| 4,366,848 | 1/1983 | Gavinski | 144/193 |
| 4,412,570 | 11/1983 | Nickerson | 144/193 |
| 4,444,232 | 4/1984 | Loos | 144/193 E |
| 4,461,331 | 7/1984 | Mertz | 144/193 |

*Primary Examiner*—W. D. Bray

*Attorney, Agent, or Firm*—Pearne, Gordon, Sessions, McCoy, Granger & Tilberry

[57] ABSTRACT

A wedge structure for log splitters is disclosed which provides a relatively thin, elongated knife at the forward end. Extending back from the knife is a first spreader providing side walls which diverge at a substantial angle. Extending rearwardly from the first spreader is a second spreader, again providing walls which diverge at a relatively large angle which is substantially greater than the angle of divergence of the first spreader. The two spreaders have a height less than the height of the knife. Secured to the upper edge of the two spreaders is a triangle-shaped plate providing diverging edges which extend laterally beyond the side edges of the spreaders to resist lifting of a log being split. The plate also ties together the upper sides of the two spreaders.

6 Claims, 2 Drawing Figures

LOG SPLITTER WEDGE CONSTRUCTION

BACKGROUND OF THE INVENTION

This invention relates generally to log splitters, and more particularly to a novel and improved wedge construction for splitting logs.

PRIOR ART

It is known to provide a log splitter wedge structure with compound wedge systems in which a relatively narrow knife portion is provided at the forward end of the wedge system with a sharp cutting edge and a spreader portion extending back from the knife portion. With such wedge constructions, the knife portion enters the end of the log, producing a crack. The force required to cause knife penetration is relatively high until the crack is formed. Once the crack is formed, the force required for continued penetration drops drastically. Further, the force required to cause initial penetration of the knife portion is a function of the angle of the sides of the knife portion. If the knife portion is relatively thin and provides a small included angle, the penetration forces are substantially less than would be present if the knife were broad or wide.

Because the force of penetration reduces after the crack is initially formed, sufficient force is available for fairly rapid spreading of the log created by a spreader portion having walls which diverge with a relatively large angle.

Further, it has been found that it is desirable to arrange the spreader portion so that it is provided with a relatively low profile and works against the log adjacent to one side thereof. With such an arrangement, it has been found that the log is cammed apart adjacent to one side and the splitting operation can be achieved with less force than required if the spreader portion has a high profile.

Examples of wedge systems illustrating a relatively narrow knife followed by spreader portions having walls which diverge at relatively large angles are illustrated in U.S. Pat. Nos. 899,828; 4,240,476; and 4,366,848.

It is also known to provide wedge structures with a vertical knife portion and a horizontally extending knife portion intended to split a log into four separate pieces within a single splitting operation. An example of such system is illustrated in U.S. Pat. No. 4,412,570.

SUMMARY OF THE INVENTION

In accordance with the present invention, a novel and improved compound wedge structure is provided for log splitters and the like. The wedge is structured to reduce the power required to perform a given splitting operation and to resist the tendency for a log to raise up off the wedge as the splitting progresses. Further, the structure is arranged to simplify and minimize the material and labor costs of manufacture while still providing very efficient operation.

In accordance with the illustrated embodiment of this invention, the wedge provides a relatively thin, vertically extending knife along the forward edge of the wedge backed up by first and second spreader wedges. The two spreader wedges have a height substantially less than the height of the knife. The first spreader wedge is joined to the rearward side of the knife and provides walls which diverge at a first predetermined angle. The second spreader wedge extends rearwardly from the first spreader wedge and provides diverging walls which diverge at a second angle greater than the first angle.

Positioned along the top of the spreader wedges and extending rearwardly of the knife is a horizontal plate providing lateral diverging edges which project beyond the diverging side walls of the two spreader wedge portions. Such edges engage a log end and prevent such log end from lifting as the wedge system penetrates the end of the log and causes the splitting thereof.

In the illustrated embodiment, the upper plate is essentially triangular in shape, having a width at its rearward end equal to the maximum width of the second spreader wedge. Such plate, in cooperation with the I-beam on which the wedge is mounted, provides lateral support for the side plates of both the first and second spreader wedges. Further, the intersection between the side walls and the first and second spreader wedges is angulated and provides stiffness to both side plates.

By providing two spreader wedges, the splitting of the log is often completed before the wedge penetrates the log any substantial distance beyond the end thereof. The narrow knife tends to minimize the initial force requirement occurring before the log is cracked. The force required for further penetration reduces so that when the end of the log engages the diverging wall of the first spreader portion, sufficient force is available to cause the spreader portion to open up the logs, often completing the splitting operation thereof. Further, as the log opens up by virtue of its moving along the first spreader portion, the force required for greater penetration reduces so that sufficient power is available to continue the opening process by movement along the diverging walls of the second spreader, even though the included angle therebetween is greater than the included angle between the walls of the first spreader.

The horizontal plate virtually eliminates any tendency for the log to raise up as the wedge penetrates into the log.

These and other aspects of this invention are illustrated in the accompanying drawings, and are more fully described in the following specification.

DETAILED DESCRIPTION OF THE DRAWINGS

Figure 1:
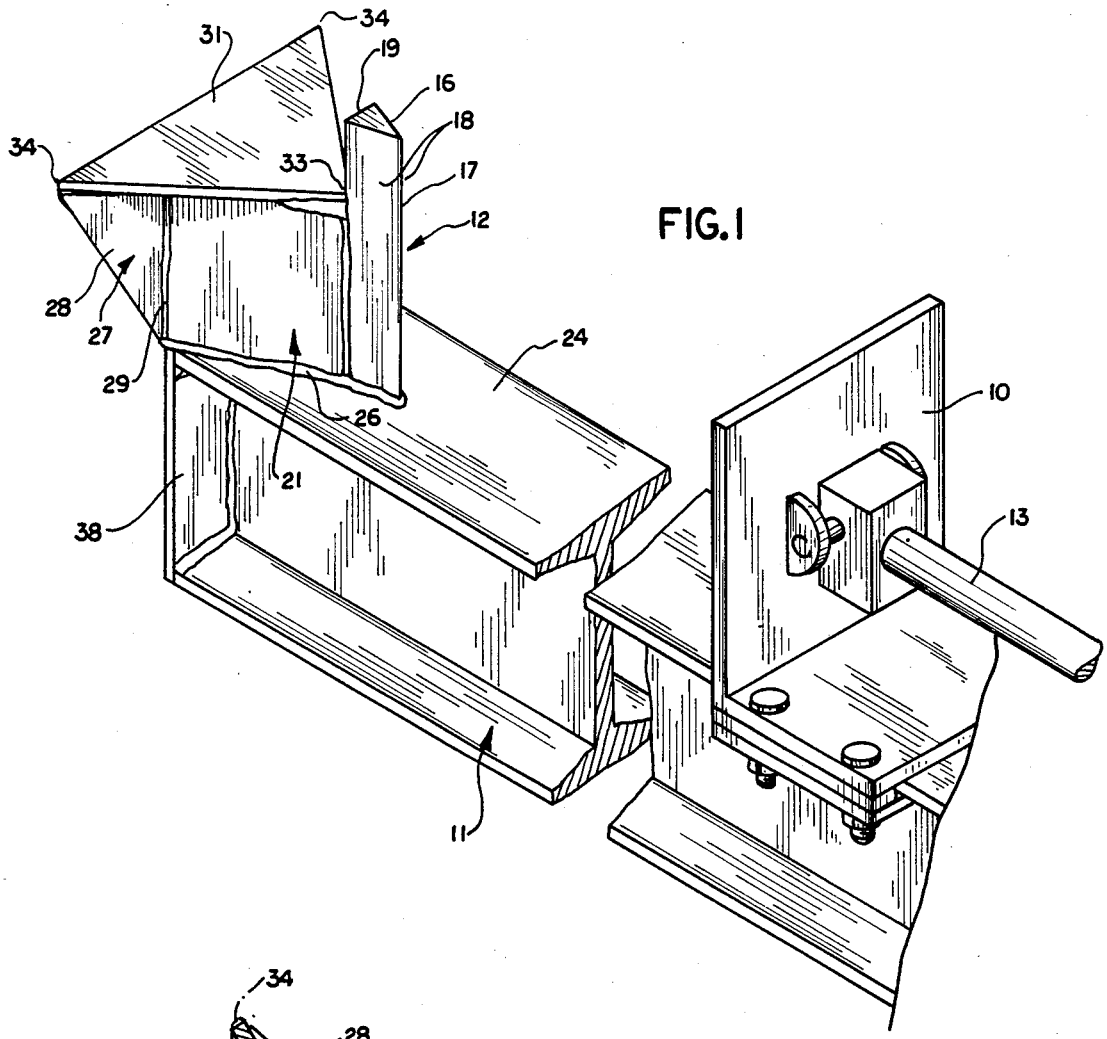
FIG. 1 is a fragmentary, perspective view of the wedge end of a log splitter illustrating the structure of a splitter wedge incorporating this invention.
Figure 2:
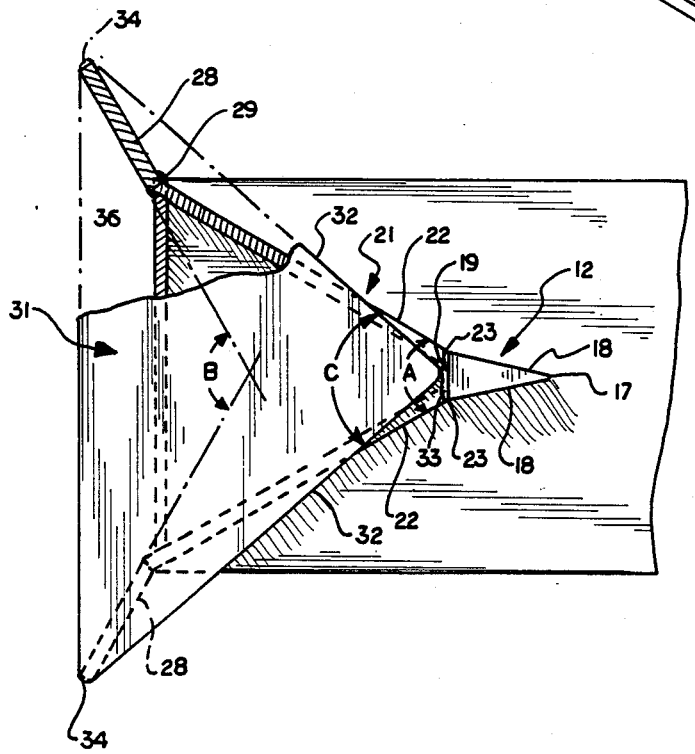
FIG. 2 is a plan view of the wedge with portions broken away to illustrate internal structure.

FIGS. 1 and 2 illustrate only the beam end wedge and pusher of a log splitter in order to simplify the illustration of the invention. It should be understood, however, that in a typical log splitter installation power means are provided to move a pusher 10 along a frame beam 11 on which a log splitting wedge 12 is mounted. Typically, the pusher 10 is powered by a hydraulic cylinder having a piston 13 connected to the pusher 10 and operable to move the pusher along the beam 11 toward and away from the wedge 12.

In many instances, an engine is also mounted on the frame to drive a pump which supplies the fluid under pressure to the cylinder through a suitable control valve. In some instances, the source of hydraulic fluid under pressure is provided by a take-off from a vehicle such as a farm tractor. U.S. Pat. Nos. 4,240,476 and 4,461,331 are incorporated herein by reference to illustrate overall systems of a hydraulic log splitter of the type for which this invention is suitable.

Although the log splitting wedge structure disclosed and claimed herein is particularly suited for use in a hydraulic log splitter, the invention herein is not limited to hydraulic log splitters per se but could be applied to other types of log splitters.

The wedge 12 includes an elongated, vertically extending knife 16 having a cutting edge 17 at the forward edge thereof and providing a triangular cross section. Therefore, the knife provides opposed, diverging sidewalls 18 which extend from the cutting edge 17 to a blunt rearward side 19. Preferably, the angle of divergence of the knife is in the order of 22°, so that the knife is relatively slender and capable of penetrating into the end of a log without excessive force.

Located behind the knife 12 is a spreader assembly having a height substantially less than the height of the knife. Such assembly includes a first spreader 21 providing diverging side plates 22 which are welded along their forward edges 23 to the blunt side 19 of the knife 12. Such side plates 22 diverge at an angle A which is greater than the angle of divergence of the side walls 18 of the knife 12. The side plates 22 are rectangular in shape and are welded along their lower edges to the upper surface 24 of the beam 11 by a weld bead 26. Such weld bead also permanently mounts the lower end of the knife on the surface 24. Preferably, the side plates 22 are sized so that their rearward edge is flush with the side edges of the beam 11.

Extending rearwardly from the first spreader 21 is a second spreader 27 consisting of two similar diverging plates 28 which are generally triangular in shape. The forward edges of the plates 28 are welded to the rearward edges of the associated side plates 22 by weld beads 29, and the plates 28 diverge with an angle B which is substantially greater than the angle of divergence A of the first spreader 21. Preferably, the angle A is about 50° and the angle B is about 95°.

A cover plate 31, which is generally triangular in shape, is welded to the upper edges of the side plates 22 and 29 and is proportioned to provide a relatively pointed corner centered behind the knife 12 at its forward end. Such plate provides side edges 32 which diverge with an angle C from the forward end at 33 to rearward corners 34. In the illustrated embodiment, the rearward corners 34 of the top plate 31 are aligned with the upper edges of the side plates 28 and flush with the outer extremities thereof. The angle C of divergence of the edges of the top plate 31 is preferably greater than the angle A and less than the angle B, so that the side edges 32 extend laterally beyond the two spreaders 21 and 27. Consequently, the top plate 31 not only closes the wedge structure and provides a rigid support for the upper edges of the side plates 22 and 28, but it also, through the lateral projecting edges, resists the tendency of a log to lift as it is split by the wedge.

Further, the difference in the angle A and the angle B is sufficiently great so that the adjacent side plates 22 and 28 joined at the weld beads 29 are angulated with respect to each other a substantial amount. With this structure, the two associated side plates provide a vertical stiffening action in that the side plate 22 tends to prevent any bending of the side plate 28 and the side plate 28 correspondingly tends to prevent any lateral bending of the side plates 22.

In most instances, an additional back plate 36 is welded across the rearward end of the first spreader 21 at the beads 29 to close the first spreader and also to improve the transmission of forces from the wedge to the upper surface 24 of the beam 21. However, in many instances, such closure plate 36 is not required because of the angle of the associated back plates 22 and 28.

In the drawings, the beam 11 illustrated is an I-beam and an end plate 38 is also provided along the end of the beam to assist in transmitting forces from the upper flange which provides the surface 24 to the lower flange.

With the illustrated structure, a relatively narrow knife 12 is provided which can penetrate into the end of a log without excessive force. As the knife 12 penetrates into the log, the log cracks and the force required to continue penetration drops drastically. This occurs normally before the end of the log reaches the first spreader.

Since the force required for continued penetration drops dramatically when the crack occurs, sufficient force is available to allow penetration of the first spreader 21 even though its walls diverge at a substantially increased angle. The action of the first spreader therefore tends to open the crack rather quickly, and often results in the complete splitting of the log without penetration of the wedge along the length of the log. Further, as the crack opens, the force for further penetration remains relatively small and eventually the end of the log reaches the second greater 27, which again functions at a more rapid rate to open the log up and complete the splitting operation. Here again, because substantial splitting has occurred before the end of the log reaches the second spreader 27, it is possible to continue penetration even though such spreader has a wide angle of divergence.

Because the edges 32 of the plate 31 extend laterally beyond the surfaces, they tend to dig into the end of the log to some extent and prevent any lifting of the log as the splitting progresses. This allows the use of a relatively low profile spreader without encountering excessive low lifting during the splitting operation. With this structure, in which the wedge spreaders are relatively low in profile compared to the height of the knife, it has been found that a camming action occurs as the spreaders operate to open up the lower side of the log, and this camming action increases the ability to cause splitting without excessive forces being encountered. Without such hold-down characteristics provided by the plate 31, the low profile spreader tends to cause a lifting action to occur on occasion. However, with the plate illustrated, such lifting of the logs is virtually eliminated.

Further, the low profile or low height of the spreaders reduces the material content of the wedge structure and reduces the cost thereof.

With the illustrated embodiment of this invention, a very efficient wedge structure is provided which is capable of improved efficiency in the splitting operation of most logs. Therefore, with this wedge structure, a given log can be split with less force applied by the pusher 10. Further, less material and labor are required during its manufacture.

Although the preferred embodiment of this invention has been shown and described, it should be understood that various modifications and rearrangements of the parts may be resorted to without departing from the scope of the invention as disclosed and claimed herein.

What is claimed is:

1. A log splitter comprising a frame, a splitting wedge on said frame, and a power means on said frame operable to cause said wedge to penetrate a log, said wedge including a knife portion providing a cutting edge extending substantially perpendicular to the direction of penetration, said knife portion providing knife side walls which intersect at said edge and diverge rearwardly therefrom at a first relatively small angle, a first spreader rearwardly of said knife providing first and second spreader side walls diverging rearwardly from associated of said knife side walls at a second angle greater than said first angle and operable to engage and open the end of a log passing over said knife, a second spreader providing third and fourth diverging side walls extending rearwardly from the associated of said first and second spreader side walls and diverging at a third angle greater than said second angle, and a plate mounted along the side of said spreaders remote from said frame, said plate providing lateral edges which diverge from the forward end substantially adjacent said knife at a fourth angle greater than said second angle, said plate operating with said frame to provide lateral support for said diverging walls, said lateral edges operating to prevent lifting of logs being split by said wedge.

2. A log splitter as set forth in claim 1, wherein said frame provides an elongated support surface on which said wedge is supported, said first and second diverging spreader walls extending to the rearward ends substantially flush with the edges of said support surface, said third and fourth diverging spreader walls diverging laterally beyond the sides of said support surface.

3. A log splitter as set forth in claim 1, wherein said lateral edges extend substantially to the rearward end of said third and fourth diverging walls.

4. A log splitter as set forth in claim 1, wherein said diverging spreader side walls of said first spreader join associated of said diverging side walls of said second spreader at a substantial angle and operate thereby to substantially increase the rigidity of each other.

5. A log splitter wedge comprising an elongated solid knife having a forward cutting edge, knife side walls which diverge rearwardly at a first angle and a blunt rearward side, a first pair of plates welded to said rearward side of said knife and diverging rearwardly at a second angle greater than said first angle, a second pair of plates welded to the rearward edge of an associated of said first pair of plates and diverging rearwardly of the third angle greater than said second angle, and a generally triangular cover plate welded to adjacent side edges of each of said plates and providing diverging edges extending laterally beyond said plates to provide anti-lifting engagement with logs being split by said wedge.

6. A log splitter wedge as set forth in claim 5, wherein said knife has ends and a height substantially greater than the height of said pairs of plates and said cover plate is positioned intermediate the ends of said knife.

* * * * *